US010175630B2

(12) United States Patent
Tsuji

(10) Patent No.: US 10,175,630 B2
(45) Date of Patent: Jan. 8, 2019

(54) IMAGE FORMING APPARATUS

(71) Applicant: KYOCERA Document Solutions Inc., Osaka (JP)

(72) Inventor: Hirofumi Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/851,314

(22) Filed: Dec. 21, 2017

(65) Prior Publication Data

US 2018/0203404 A1 Jul. 19, 2018

(30) Foreign Application Priority Data

Jan. 16, 2017 (JP) ..... 2017-004810

(51) Int. Cl.
*G03G 15/00* (2006.01)
*G03G 21/00* (2006.01)

(52) U.S. Cl.
CPC ..... *G03G 15/757* (2013.01); *G03G 21/0005* (2013.01); *G03G 21/0094* (2013.01); *G03G 15/751* (2013.01)

(58) Field of Classification Search
CPC ..... G03G 15/75; G03G 15/751; G03G 15/757
USPC ..... 73/155, 159, 167
See application file for complete search history.

(56) References Cited

U.S. PATENT DOCUMENTS 4,425,036 A * 1/1984 Kameyama ..... G03G 15/757 355/133
7,318,539 B2 * 1/2008 Vitantonio ..... B05B 9/0861 222/333
9,594,338 B2 3/2017 Morishita et al.
2012/0163866 A1 * 6/2012 Morishita ..... G03G 15/757 399/167
2014/0184717 A1 * 7/2014 Ishizaki ..... G03G 15/0189 347/118
2016/0252868 A1 9/2016 Morishita et al.

FOREIGN PATENT DOCUMENTS

JP 2016-157047 A 9/2016

* cited by examiner

*Primary Examiner* — Benjamin R Schmitt
(74) *Attorney, Agent, or Firm* — Studebaker & Brackett PC

(57) ABSTRACT

An image forming apparatus includes a photosensitive drum, a cleaning blade, and a movement mechanism. The movement mechanism reciprocates the photosensitive drum in an axial direction of the photosensitive drum in a specific cycle. The movement mechanism includes a first cam gear and a second cam gear. The first cam gear rotates about an axis of the photosensitive drum together with the photosensitive drum. The second cam gear is restricted in position in the axial direction and rotates at a rotational speed different from that of the first cam gear. The first and second cam gears each have a plurality of coaxial cam portions. When top points and bottom points of the respective cam portions come in contact with one another by turns, the photosensitive drum moves in the axial direction.

8 Claims, 9 Drawing Sheets

IMAGE FORMING APPARATUS

INCORPORATION BY REFERENCE

The present application claims priority under 35 U.S.C. § 119 to Japanese Patent Application No. 2017-004810, filed on Jan. 16, 2017. The contents of this application are incorporated herein by reference in their entirety.

BACKGROUND

The present disclosure relates to an image forming apparatus that forms an image.

In an electrographic image forming apparatus such as a copier, a printer, or a facsimile machine, a toner image is formed on an image bearing member (photosensitive drum) in a manner that an electrostatic latent image formed on the image bearing member is developed by supplying toner to the electrostatic latent image. When the toner image is transferred to a sheet and subjected to specific fixing processing, an image is formed on the sheet.

SUMMARY

An image forming apparatus according to one aspect of the present disclosure includes: a housing; a photosensitive drum having a circumferential surface and supported to the housing in rotatable manner about an axis of the photosensitive drum, the circumferential surface of the photosensitive drum being a circumferential surface on which an electrostatic latent image is to be formed and a developer image is to be carried; a cleaning member supported to the housing and configured to clean the circumferential surface of the photosensitive drum while in contact with the circumferential surface of the photosensitive drum; and a movement mechanism configured to reciprocate the photosensitive drum in an axial direction of the photosensitive drum. The movement mechanism includes: a first cam member fixed to the photosensitive drum and configured to rotate about the axis of the photosensitive drum together with the photosensitive drum in an integral manner; and a second cam member disposed opposite to the first cam member in the axial direction of the photosensitive drum and configured to rotate about the axis of the photosensitive drum at a rotational speed different from that of the first cam member, a position of the second cam member being restricted in the axial direction of the photosensitive drum. The first cam member includes: a first cam portion having a ring shape extending around the axis of the photosensitive drum in a first rotational direction in which the first cam member rotates with a specific width in a first radial direction in rotation of the first cam member, the first cam portion protruding toward the second cam member such as to have a height varying in the first rotational direction; a second cam portion having a ring shape extending around the axis of the photosensitive drum in the first rotational direction with a specific width in the first radial direction and disposed adjacent to the first cam portion, the second cam portion protruding toward the second cam member such as to have a height varying in the first rotational direction; and a third cam portion having a ring shape extending around the axis of the photosensitive drum in the first rotational direction with a specific width in the first radial direction and disposed adjacent to the second cam portion on an opposite side to the first cam portion in the first radial direction, the third cam portion protruding toward the second cam member such as to have a height varying in the first rotational direction. The second cam member includes: a fourth cam portion having a ring shape extending around the axis of the photosensitive drum in a second rotational direction in which the second cam member rotates with a specific width in a second radial direction in rotation of the second cam member, the fourth cam portion protruding toward the first cam portion of the first cam member such as to have a height varying in the second rotational direction; a fifth cam portion having a ring shape extending around the axis of the photosensitive drum in the second rotational direction with a specific width in the second radial direction and disposed adjacent to the fourth cam portion, the fifth cam portion protruding toward the second cam portion of the first cam member such as to have a height varying in the second rotational direction; and a sixth cam portion having a ring shape extending around the axis of the photosensitive drum in the second rotational direction with a specific width in the second radial direction and disposed adjacent to the fifth cam portion on an opposite side to the fourth cam portion in the second radial direction, the sixth cam portion protruding toward the third cam portion of the first cam member such as to have a height varying in the second rotational direction. The first, second, and third cam portions of the first cam member include: respective first top points located closest to the second cam member at positions different from one another in the first rotational direction; and respective first bottom points located farthest from the second cam member at positions different from one another in the first rotational direction. The fourth, fifth, and sixth cam portions of the second cam member include: respective second top points located closest to the first cam member at positions different from one another in the second rotational direction; and respective second bottom points located farthest from the first cam member at positions different from one another in the second rotational direction. When the first top points of the first, second, and third cam portions respectively come in contact with the second top points of the fourth, fifth, and sixth cam portions along with rotation of the first and second cam members about the axis of the photosensitive drum, the photosensitive drum is positioned at a first position farthest from the second cam member. When the first top points of the first, second, and third cam portions respectively come in contact with the second bottom points of the fourth, fifth, and sixth cam portions along with rotation of the first and second cam members about the axis of the photosensitive drum, the photosensitive drum is positioned at a second position closest to the second cam member.

DETAILED DESCRIPTION

Figure 1:
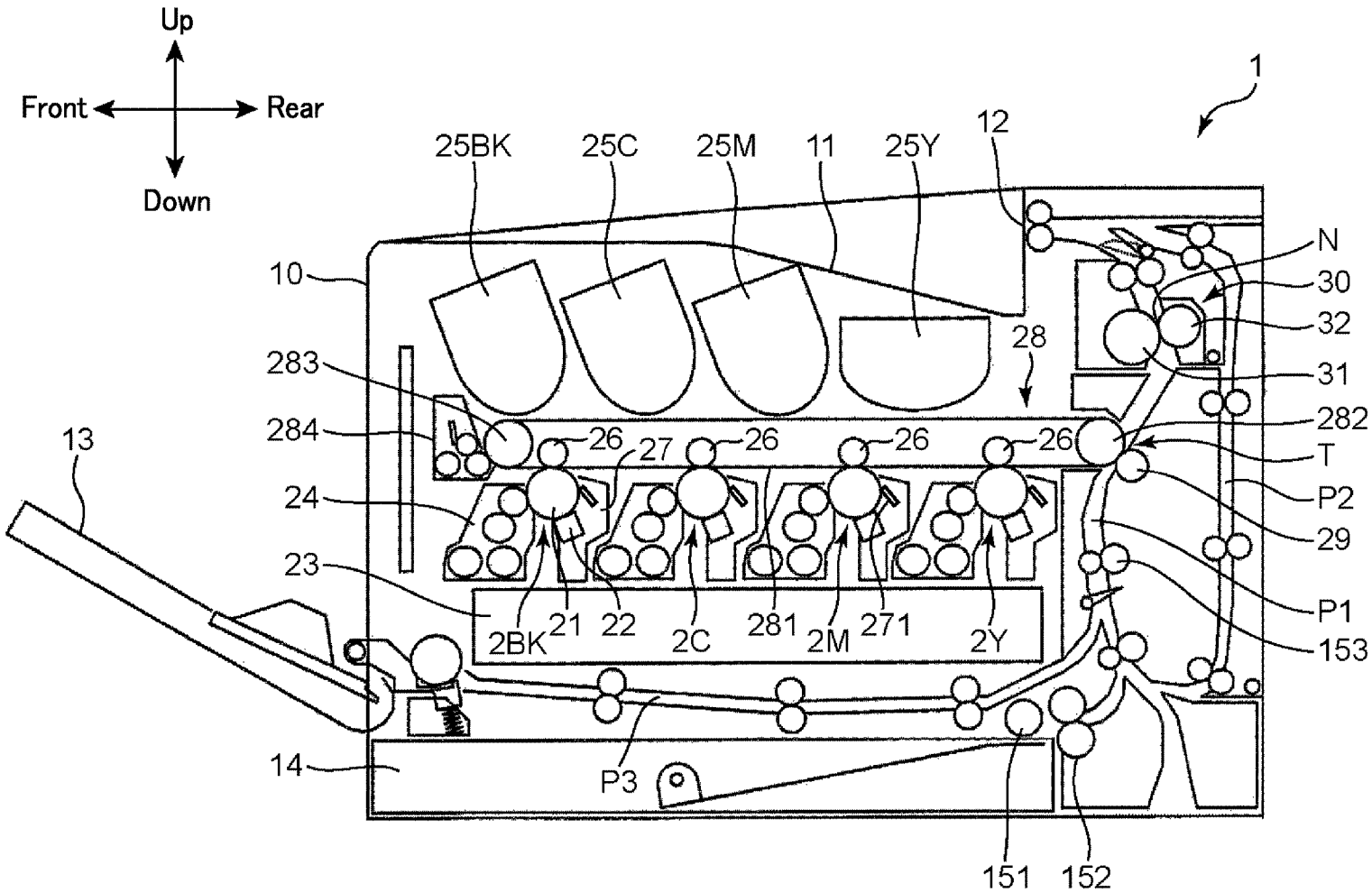
FIG. 1 is a cross-sectional view illustrating a general configuration of an image forming apparatus according to an embodiment of the present disclosure.

The following describes an embodiment of the present disclosure with reference to drawings. FIG. 1 is a schematic cross-sectional view illustrating an internal configuration of an image forming apparatus 1 according to the embodiment of the present disclosure. The image forming apparatus 1 is for example a tandem color printer. The image forming apparatus 1 includes a body housing 10 having a substantially rectangular parallelepiped shape. Note that the image forming apparatus 1 may be a full color or monochrome copier. Alternatively, the image forming apparatus 1 may be a full color or monochrome multifunction peripheral.

The body housing 10 accommodates therein a plurality of processing units that each perform image formation on a sheet. In the present embodiment, the processing units include image forming units 2Y, 2C, 2M, 2Bk, an optical scanning device 23, an intermediate transfer unit 28, and a fixing device 30. The body housing 10 has an upper surface that serves as an exit tray 11. The body housing 10 has a sheet exit port 12 open toward the exit tray 11. A manual feed tray 13 is mounted on a side wall of the body housing 10 in an openable and closable manner. A sheet feed cassette 14 is fitted to a lower part of the body housing 10 in an attachable and detachable manner. The sheet feed cassette 14 accommodates a stack of sheets to be subjected to image formation.

The image forming units 2Y, 2C, 2M, and 2Bk respectively form toner images in colors of for example yellow, cyan, magenta, and black based on image information transmitted from an external device. The image forming units 2Y, 2C, 2M, and 2Bk may be referred collectively to below as image forming units 2Y to 2Bk. The external device is for example a computer. The image forming units 2Y to 2Bk are disposed in tandem at specific regular intervals in a horizontal direction. The image forming units 2Y to 2Bk each include a photosensitive drum 21, a charger 22, a developing device 24, a primary transfer roller 26, a cleaner 27, and a corresponding one of a toner container 25Y, a toner container 25C, a toner container 25M, and a toner container 25Bk. The photosensitive drum 21 has a circumferential surface on which an electrostatic latent image is to be formed and a toner image (developer image) is to be carried. The photosensitive drum 21 has for example a cylindrical shape. The charger 22 charges the circumferential surface of the photosensitive drum 21. The developing device 24 attaches developer to the electrostatic latent image to form the toner image. The toner container 25Y supplies yellow toner to the developing device 24 of the image forming unit 2Y. The toner container 25C supplies cyan toner to the developing device 24 of the image forming unit 2C. The toner container 25M supplies magenta toner to the developing device 24 of the image forming unit 2M. The toner container 25Bk supplies black toner to the developing device 24 of the image forming unit 2Bk. The primary transfer roller 26 primarily transfers a toner image formed on the photosensitive drum 21. The cleaner 27 removes residual toner on the circumferential surface of the photosensitive drum 21.

The optical scanning device 23 forms an electrostatic latent image on the circumferential surface of each of the photosensitive drums 21. The optical scanning device 23 in the present embodiment includes a plurality of light sources and an imaging optical system. The light sources each are provided for a corresponding one of the photosensitive drums 21. The imaging optical system causes light beams emitted from the respective light sources to image and scan the circumferential surfaces of the respective photosensitive drums 21.

The intermediate transfer unit 28 primarily transfers the toner images formed on the respective photosensitive drums 21. The intermediate transfer unit 28 includes a transfer belt 281, a drive roller 282, and a driven roller 283. The transfer belt 281 circulates while in contact with the circumferential surfaces of the respective photosensitive drums 21. The transfer belt 281 is wound around the drive roller 282 and the driven roller 283. The transfer belt 281 is pressed against the circumferential surfaces of the respective photosensitive drums 21 by the primary transfer rollers 26. The toner images on the respective photosensitive drums 21 are primarily transferred to a part of the transfer belt 281 in a superposed manner. Through the above, a full color toner image is formed on the transfer belt 281.

A secondary transfer roller 29 is disposed opposite to the drive roller 282. The secondary transfer roller 29 and the drive roller 282 form a secondary transfer nip part T with the transfer belt 281 therebetween. The full color toner image on the transfer belt 281 is secondarily transferred to a sheet when the sheet passes through the secondary transfer nip part T. Toner not transferred to the sheet and remaining on the circumferential surface of the transfer belt 281 is collected by a belt cleaner 284. The belt cleaner 284 is disposed opposite to the driven roller 283.

The fixing device 30 includes a fixing roller 31 and a pressure roller 32. The fixing roller 31 includes a heat source therein. The pressure roller 32 forms a fixing nip part N in cooperation with the fixing roller 31. The fixing device 30 applies heat and pressure at the fixing nip part N to the sheet to which the full color toner image has been transferred through the secondary transfer nip part T. In a manner as above, the fixing device 30 performs fixing to melt the toner and attach the toner to the sheet. The sheet subjected to fixing is ejected onto the exit tray 11 from the sheet exit port 12.

A sheet conveyance path through which a sheet is conveyed is formed in the interior of the body housing 10. The sheet conveyance path includes a main conveyance path P1, a reversed sheet conveyance path P2, and a manually fed sheet conveyance path 3P. The main conveyance path P1 extends in an up-and-down direction from near a lower part to near an upper part of the body housing 10 via the secondary transfer nip part T and the fixing device 30. The main conveyance path P1 has a downstream end connected to the sheet exit port 12. The reversed sheet conveyance path P2 extends from a most downstream end to near an upstream end of the main conveyance path P1. A sheet is reversed and conveyed in the reversed sheet conveyance path P2 in duplex printing. In addition, the manually fed sheet conveyance path P3 extends above the sheet feed cassette 14. The manually fed sheet conveyance path P3 extends from the manual feed tray 13 to the upstream end of the main conveyance path P1.

The sheet feed cassette 14 includes a sheet accommodation section that accommodates a stack of sheets. A pickup roller 151 and a sheet feed roller pair 152 are disposed near an upper right part of the sheet feed cassette 14. The pickup roller 151 picks up a topmost sheet from the stack of sheets one at a time. The sheet feed roller pair 152 feeds the sheet picked up by the pickup roller 151 to the upstream end of the main conveyance path P1. Note that a sheet loaded on the manual feed tray 13 is also fed to the upstream end of the main conveyance path P1 through the manually fed sheet conveyance path P3. A registration roller pair 153 is disposed upstream of the secondary transfer nip part T in the main conveyance path P1. The registration roller pair 153 feeds the sheet toward the secondary transfer nip part T at a specific timing.

Figure 2A:
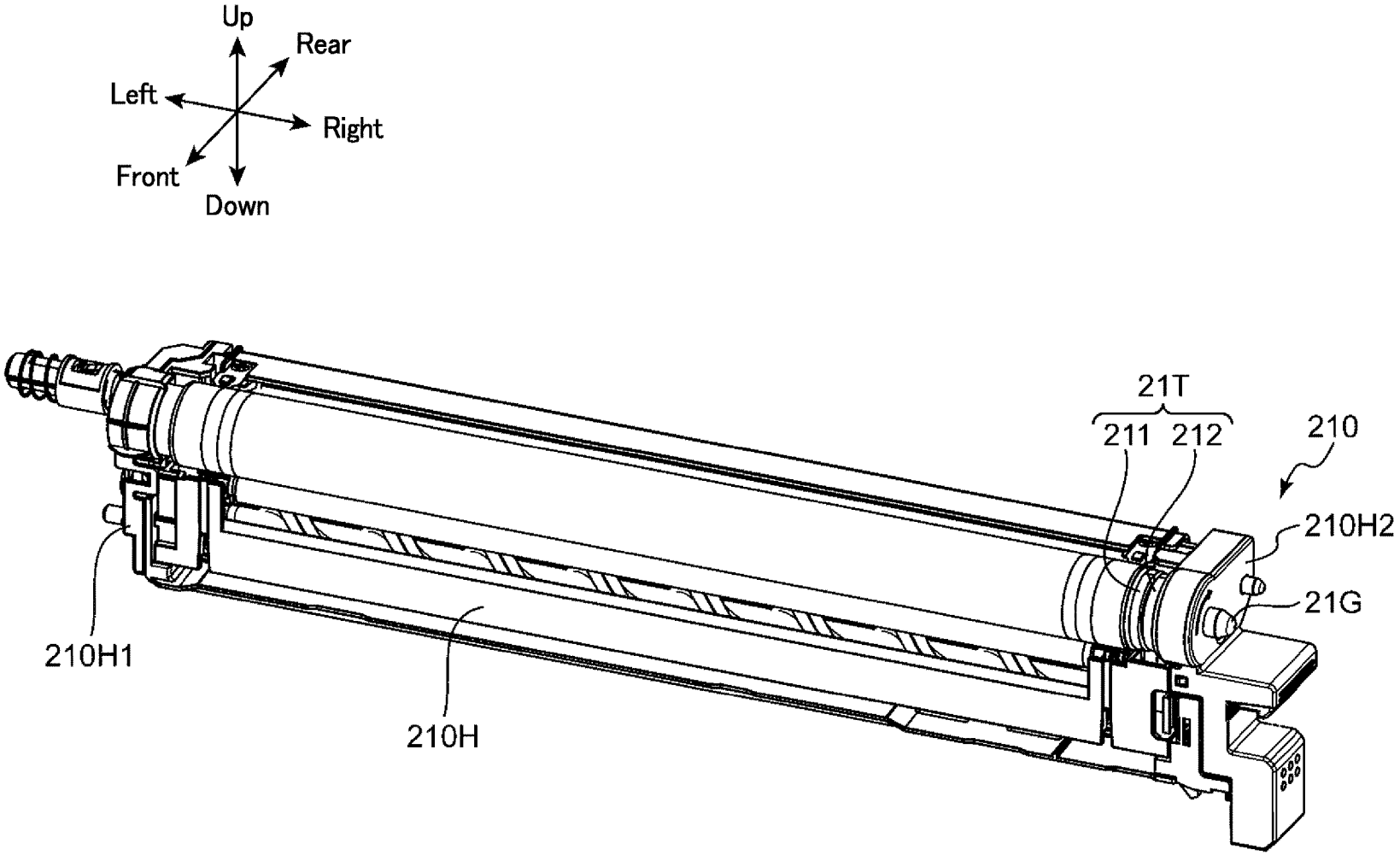
FIG. 2A is a perspective view of a drum unit according to an embodiment of the present disclosure.
Figure 2B:
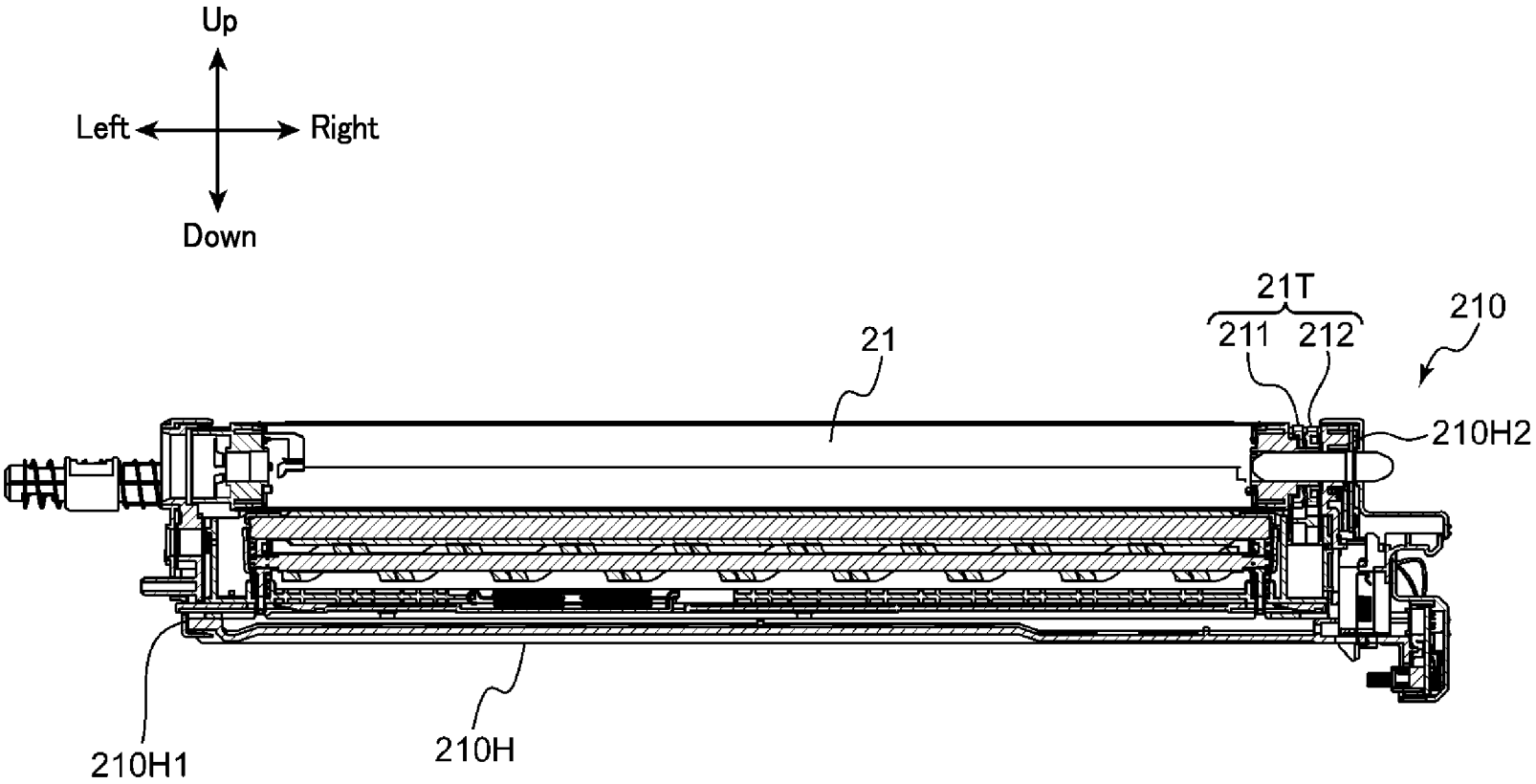
FIG. 2B is a front view of the drum unit according to an embodiment of the present disclosure.
Figure 3:
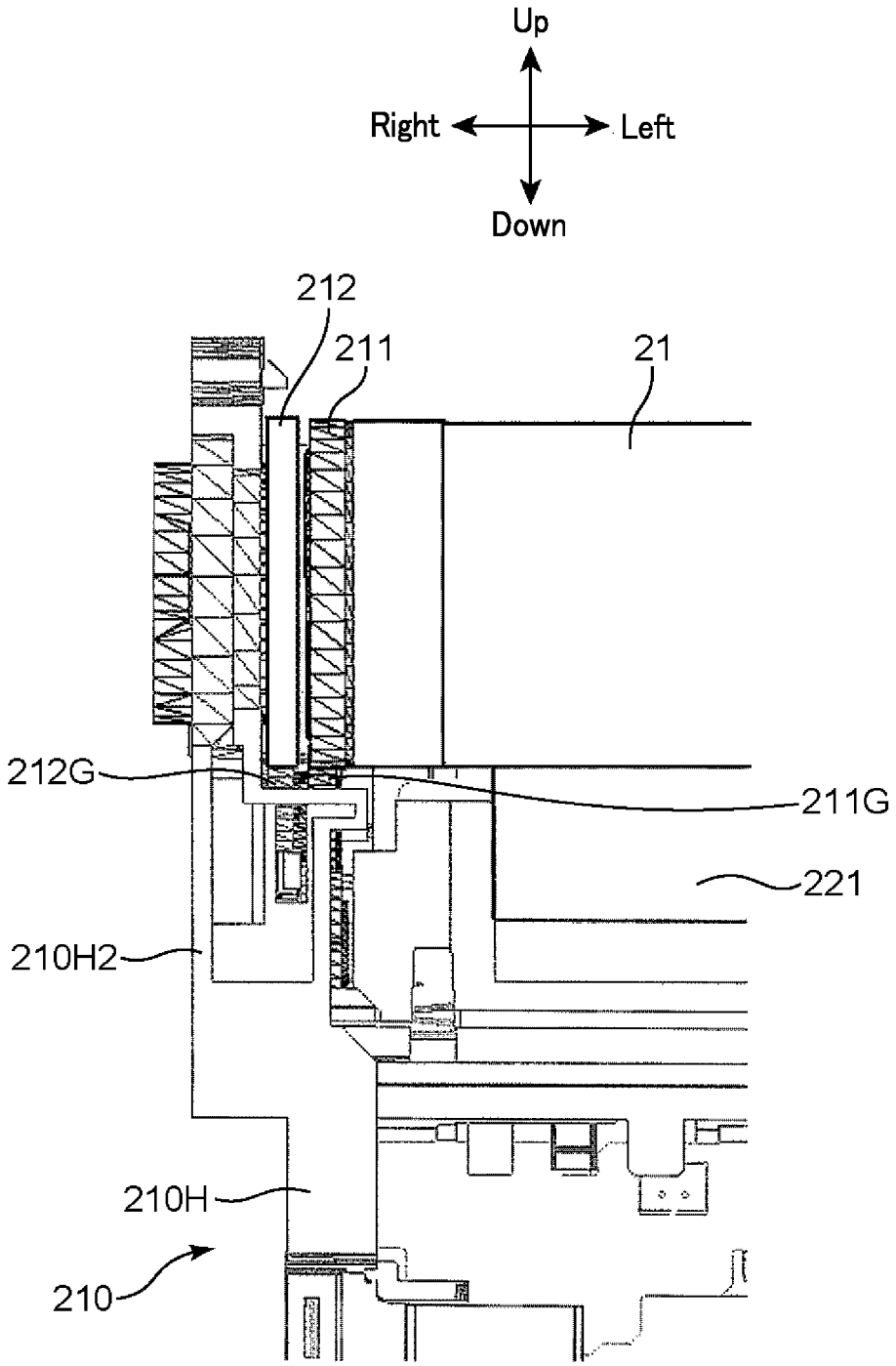
FIG. 3 is an enlarged rear view of a part of the drum unit according to an embodiment of the present disclosure.
Figure 4:
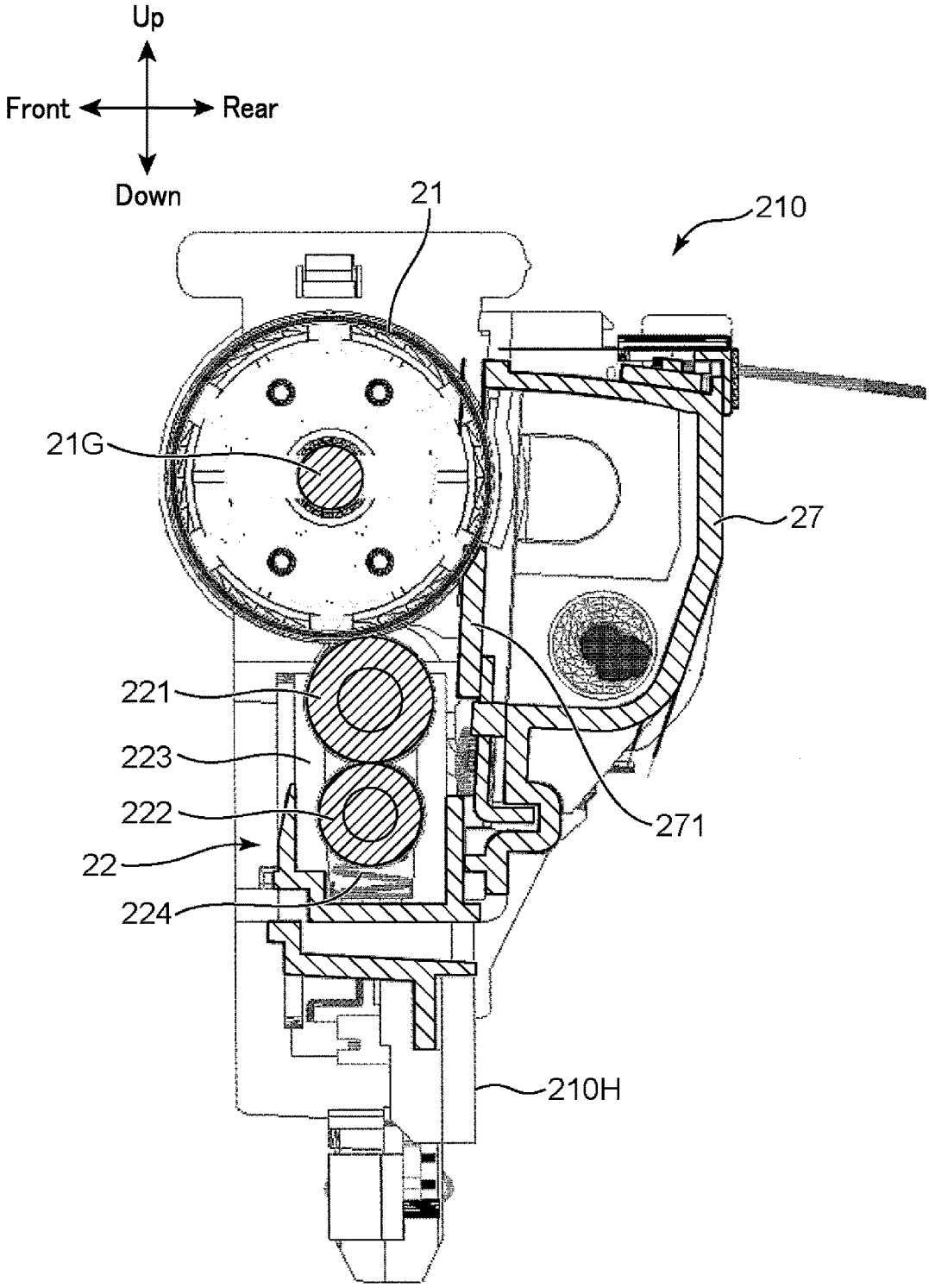
FIG. 4 is a cross-sectional view of the drum unit according to an embodiment of the present disclosure.

Description will be given further in detail of configuration around one of the photosensitive drums 21 of the image forming units 2Y to 2Bk with reference to FIGS. 2A to 4. FIG. 2A is a perspective view of a drum unit 210 according to the present embodiment. FIG. 2B is a front view of the drum unit 210. FIG. 3 is an enlarged rear view of a part (right end part) of the drum unit 210. FIG. 4 is a cross-sectional view of the drum unit 210. The following description refers to one (image forming unit 2Y) of the image forming units 2Y to 2Bk as an example. Note that the image forming units 2Y to 2Bk have the same configuration.

Referring to FIGS. 2A and 2B, the image forming unit 2Y includes the drum unit 210. The drum unit 210 has a box shape extending in a left-right direction. The drum unit 210 is attachable to and detachable from the body housing 10. The photosensitive drum 21, the charger 22, and the cleaner 27 are supported to the drum unit 210.

The drum unit 210 includes a unit housing 210H (housing). The unit housing 210H is made from a resin material. The unit housing 210H is a box that supports the photosensitive drum 21, the charger 22, and the cleaner 27. Referring to FIG. 2B, the drum unit 210 has a substantially rectangular U-shape open upward when viewed from front. The unit housing 210H includes a unit left wall 210H1 and a unit right wall 210H2. The unit left wall 210H1 and the unit right wall 210H2 are side walls standing at the respective opposite ends of the unit housing 210H in the left-right direction. The unit left wall 210H1 and the unit right wall 210H2 support the photosensitive drum 21 in a rotatable manner.

The photosensitive drum 21 has a cylindrical shape. An electrostatic latent image is to be formed on the circumferential surface of the photosensitive drum 21 and a toner image is to be carried thereon. The body housing 10 includes a drum shaft 21G (see FIG. 4). The drum shaft 21G extends in the left-right direction in the body housing 10. The drum shaft 21G has an axis passing through the center of the drum shaft 21G and extending in a direction in which the drum shaft 21G extends. When the drum unit 210 is fitted to the body housing 10, the drum shaft 21G is inserted through the photosensitive drum 21. As a result, a position of an axis of the photosensitive drum 21 is determined. The axis of the photosensitive drum 21 coincides with the axis of the drum shaft 21G.

Note that when the drum unit 210 is fitted to the body housing 10, rotational drive force of a non-illustrated motor (drive mechanism) disposed in the body housing 10 is transmitted to the photosensitive drum 21. As a result, the photosensitive drum 21 is rotated about the drum shaft 21G (about the axis of the drum shaft 21G).

Referring to FIG. 4, the charger 22 includes a charging roller 221, a brush roller 222, charger walls 223, and a roller spring 224. The charging roller 221 uniformly charges the circumferential surface of the photosensitive drum 21 to a specific potential while rotating following rotation of the photosensitive drum 21. The brush roller 222 is a roller member having conductive bristles disposed radially around a shaft of the brush roller 222. The brush roller 222 rotates to clean the surface of the charging roller 221. The charger walls 223 are paired. The paired charger walls 223 are disposed in an axial direction of the brush roller 222 with a space from each other. The charging roller 221 and the brush roller 222 are disposed between the charger walls 223. The charger walls 223 rotatably support the charging roller 221 and the brush roller 222 in a manner to keep a distance between an axis of the charging roller 221 and that of the brush roller 222 constant. The roller spring 224 is a spring member that pushes the brush roller 222 to urge the charging roller 221 toward the photosensitive drum 21.

The cleaner 27 includes a cleaning blade 271 (cleaning member). The cleaning blade 271 is a plate-shaped elastic member that is supported by the unit housing 210H and in contact with the circumferential surface of the photosensitive drum 21. The cleaning blade 271 cleans the circumferential surface of the photosensitive drum 21.

The drum unit 210 further includes a movement mechanism 21T (see FIG. 2A). The movement mechanism 21T reciprocates the photosensitive drum 21 in an axial direction of the photosensitive drum 21 (left-right direction) in a specific cycle. The movement mechanism 21T includes a first cam gear 211 (first cam member), a second cam gear 212 (second cam member), a first intermediate gear 211G, and a second intermediate gear 212G.

The first cam gear 211 is a rotary gear fixed at a flange of the photosensitive drum 21. The first cam gear 211 has an outer circumferential part (first gear portion 211H in FIG. 5A) at which a spur gear having a specific number of teeth is formed. The first cam gear 211 rotates about the drum shaft 21G together with the photosensitive drum 21. The first cam gear 211 includes a first cam portion 211A, a second cam portion 211B, and a third cam portion 211C. The first, second, and third cam portions 211A, 211B, and 211C each are a cam disposed opposite to the second cam gear 212.

The second cam gear 212 is disposed opposite to the first cam gear 211 and aligned therewith in an axial direction of the second cam gear 212 that is aligned with the axial direction of the photosensitive drum 21. The second cam gear 212 is a rotary gear supported by the unit right wall 210H2 in a rotatable manner. The second cam gear 212 has an outer circumferential part (second gear portion 212H in FIG. 5B) at which a spur gear is formed. The number of teeth of the spur gear is different from that of the spur gear at the outer circumferential part of the first cam gear 211. Note that the second cam gear 212 (right side thereof) is restricted in position in the axial direction thereof by the unit right wall 210H2. That is, the position of the second cam gear 212 in the axial direction thereof is fixed at a specific position. In the above configuration, the second cam gear 212 rotates about the drum shaft 21G while not moving in the axial direction thereof. As will be described later, the second cam gear 212 rotates at a rotational speed different by a specific speed difference (at a different rotational speed) from a rotational speed of the first cam gear 211. The second cam gear 212 includes a fourth cam portion 212A, a fifth cam portion 212B, and a sixth cam portion 212C, which will be described later. These cam portions 212A, 212B, and 212C each are a cam disposed opposite to the first cam gear 211.

The first and second intermediate gears 211G and 212G (see FIG. 3) are paired rotary gears. The first and second intermediate gears 211G and 212G are each rotatable about a parallel axis that is parallel to the axis of the photosensitive drum 21. In the present embodiment, the parallel axis that is the rotational axis of the first and second intermediate gears 211G and 212G is aligned with a rotational axis of the charging roller 221. The first intermediate gear 211G meshes with the gear teeth of the first cam gear 211.

The second intermediate gear 212G is disposed adjacent to the first intermediate gear 211G in an axial direction thereof. The second intermediate gear 212G meshes with the gear teeth of the second cam gear 212. The second intermediate gear 212G has teeth of which number is different from that of the teeth of the first intermediate gear 211G. The first and second intermediate gears 211G and 212G are connected together by means of a non-illustrated engaging claw. In the above configuration, the first intermediate gear 211G rotates about the parallel axis together with the second intermediate gear 212G.

When the photosensitive drum 21 is rotated by rotational drive force generated by the non-illustrated motor, the first cam gear 211 rotates together with the photosensitive drum 21. When the first cam gear 211 is rotated, the rotational drive force is transmitted from the first cam gear 211 to the first intermediate gear 211G. In so doing, the second intermediate gear 212G rotates together with the first intermediate gear 211G. The second cam gear 212 to which the rotational drive force is transmitted from the second intermediate gear 212G rotates in the same direction as a direction in which the first cam gear 211 rotates at a rotational speed that is slightly different from that of the first cam gear 211. That is, transmission of rotation of the photosensitive drum 21 to the second cam gear 212 from the first cam gear 211 via the first and second intermediate gears 211G and 212G causes the second cam gear 212 to rotate at a rotational speed different from that of the first cam gear 211.

When the first and second cam gears 211 and 212 rotate at respective rotational speeds slightly different from each other, the cam portions of the first cam gear 211 mesh with the cam portions of the second cam gear 212 at a specific cycle. As described above, the second cam gear 212 is restricted in position in the axial direction thereof. In the above configuration, the second cam gear 212 pushes the first cam gear 211 leftward at a specific cycle according to meshing between the respective cam portions of the first and second cam gears 211 and 212. Note that the photosensitive drum 21 is urged rightward by a non-illustrated pushing spring disposed between the unit left wall 210H1 and the drum unit 210. The photosensitive drum 21 is reciprocated in the axial direction thereof by cyclic pushing force of the second cam gear 212 and urging force of the pushing spring.

Along with reciprocation of the photosensitive drum 21, a contact point of the cleaning blade 271 in contact with the photosensitive drum 21 moves in the axial direction of the photosensitive drum 21. In the above configuration, foreign matter and agglomerated developer (toner) caught between the cleaning blade 271 and the circumferential surface of the photosensitive drum 21 are removed. As a result, a situation in which scratch formation or eccentric abrasion in the circumferential direction is caused on the circumferential surface of the photosensitive drum 21 can be prevented.

Note that the spur gear on the outer circumferential part of the first cam gear 211 has 36 teeth and the spur gear on the outer circumferential part of the second cam gear 212 has 33 teeth, as examples in the present embodiment. Furthermore, a spur gear on the outer circumferential part of the first intermediate gear 211G has 13 teeth and a spur gear on the outer circumferential part of the second intermediate gear 212G has 12 teeth. In the present embodiment, relative rotation of the first and second cam gears 211 and 212 is achieved by differentiating the number of the gear teeth between the first intermediate gear 211G and the second intermediate gear 212G. In the above configuration, stable reciprocation of the photosensitive drum 21 can be achieved. The first and second cam gears 211 and 212 and the first and second intermediate gears 211G and 212G each are a profile shifted gear that appropriately meshes with corresponding gears according to difference in the number of teeth.

The photosensitive drum 21 plies in the axial direction thereof one time during 71.5 rotations thereof about the drum shaft 21G. Reciprocation of the photosensitive drum 21 in a long cycle as above can prevent image displacement when compared to a configuration in which the photosensitive drum 21 plies in a short cycle during printing. Specifically, when ten sheets are printed successively in a configuration in which the photosensitive drum 21 reciprocates in a short cycle of for example one reciprocation per 15 rotations, the position of the photosensitive drum 21 in the axial direction thereof significantly differs between in printing on the first sheet and in printing on the fifth sheet. As a result, significant image defect such as image displacement is liable to occur. However, reciprocation in a long cycle such as above (specific cycle) can prevent occurrence of image defect.

Meanwhile, in a configuration in which the first and second cam gears 211 and 212 are in contact at one point with each other, discontinuous and abrupt movement of the photosensitive drum 21 in the axial direction thereof is liable to be caused particularly along with a fall of the first cam gear 211 (inclination relative to the axial direction thereof). As a result, significant image displacement may occur. It is unfavorable that in meshing between the first and second cam gears 211 and 212, sliding pushing force in a radial direction thereof is applied to contact parts between the respective cam portions. In a situation in which the sliding pushing force in the radial direction thereof is applied to the contact parts between the respective cam portions in meshing between the first and second cam gears 211 and 212, the cam portions may relatively displace in the radial direction thereof cyclically (shaft wobbling) to cause image displacement of an image formed on the circumferential surface of the photosensitive drum 21. In order to solve the above problems, the first and second cam gears 211 and 212 each include a plurality of (three) cam portions in the present embodiment.

Figure 5B:
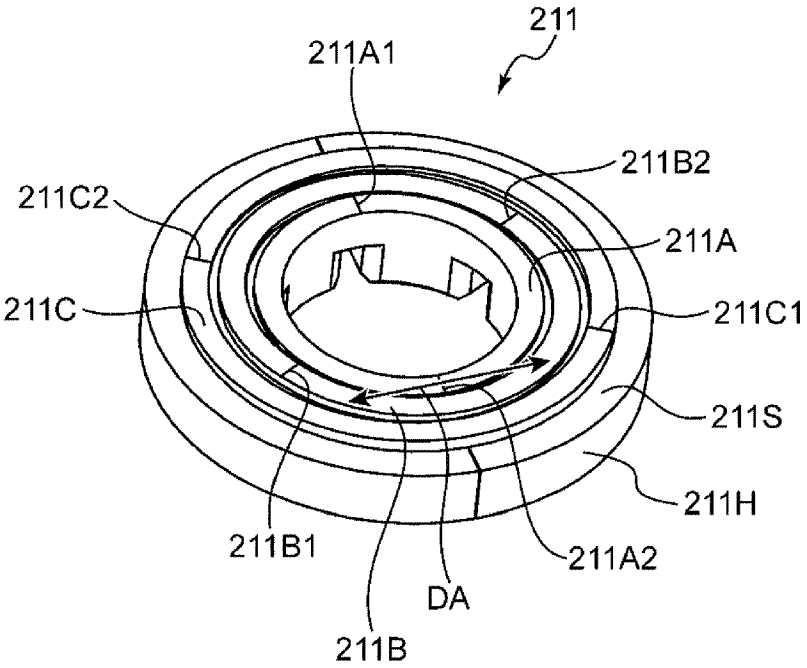
FIG. 5A is a perspective view of a first cam member according to an embodiment of the present disclosure and FIG. 5B is a perspective view of a second cam member according to an embodiment of the present disclosure.
Figure 5A:
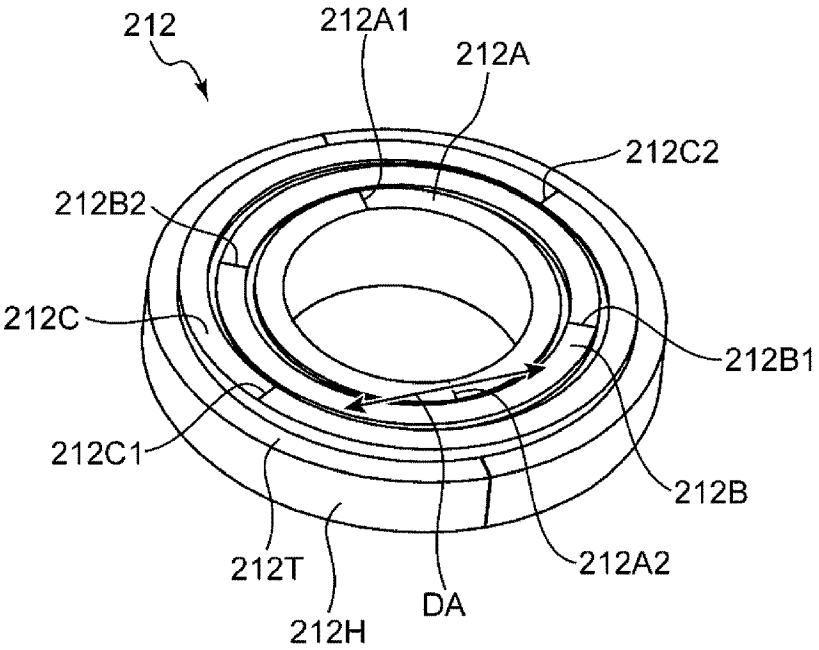

FIGS. 5A and 5B are perspective views of the first and second cam gears 211 and 212, respectively, according to the present embodiment. Note that FIG. 5A illustrates the first cam gear 211 in FIG. 3 in perspective as viewed from upper right and FIG. 5B illustrates the second cam gear 212 in FIG. 3 in perspective as viewed from upper left. That is, surfaces of the first and second cam gears 211 and 212 that face each other are illustrated in front of the drawing surface in FIGS. 5A and 5B, respectively. The respective surfaces of the first and second cam gears 211 and 212 that face each other refer to a first side surface 211S of the first cam gear 211 and a second side surface 212T of the second cam gear 212, respectively.

The first gear portion 211H of the first cam gear 211 and the second gear portion 212H of the second cam gear 212 each have a substantially ring shape. The first and second gear portions 211H and 212H each have gear teeth. The number of the gear teeth of the first gear portion 211H is different from that of the gear teeth of the second gear portion 212H. The first cam gear 211 has first grooves 211P in addition to the first, second, and third cam portions 211A, 211B, and 211C. The first, second, and third cam portions 211A, 211B, and 211C and the first grooves 211P form the first side surface 211S.

The first cam portion 211A is disposed the most inward of the three cam portions of the first cam gear 211 in a radial direction of the first cam gear 211. The first cam portion 211A is a band-shaped protrusion protruding toward the second cam gear 212 such as to have a height varying in a rotational direction (first rotational direction) of the first cam gear 211. In other words, the first cam portion 211A has a specific width in a radial direction in rotation of the first cam gear 211 (first radial direction). The first cam portion 211A has a ring shape extending in the first rotational direction around the drum shaft 21G.

The second cam portion 211B is disposed in middle among the corresponding three cam portions. In other words, the second cam portion 211B is disposed outside the first cam portion 211A in the first radial direction in an adjacent manner. The second cam portion 211B is a band-shaped protrusion protruding toward the second cam gear 212 such as to have a height varying in the rotational direction (first rotational direction) of the first cam gear 211. In other words, the second cam portion 211B has a specific width in the radial direction in rotation of the first cam gear 211 (first radial direction). The second cam portion 211B has a ring shape extending in the first rotational direction around the drum shaft 21G.

The third cam portion 211C is disposed the most outward of the corresponding three cam portions in the radial direction of the first cam gear 211. In other words, the third cam portion 211C is disposed on an opposite side of the second cam portion 211B to the first cam portion 211A in the first radial direction such as to be adjacent to the second cam portion 211B. The third cam portion 211C is a band-shaped protrusion protruding toward the second cam gear 212 such as to have a height varying in the rotational direction (first rotational direction) of the first cam gear 211. In other words, the third cam portion 211C has a specific width in the radial direction in rotation of the first cam gear 211 (first radial direction). The third cam portion 211C has a ring shape extending in the first rotational direction around the drum shaft 21G.

The first grooves 211P each are a ring-shaped recess located in a corresponding one of a part between the first and second cam portions 211A and 211B and a part between the second and third cam portions 211B and 211C. The first grooves 211P each have a specific width in the first radial direction.

The first, second, and third cam portions 211A, 211B, and 211C in the present embodiment each have an upper surface (cam surface) that is continuously curved in the first rotational direction. When the curved surfaces are viewed in the first radial direction while being moved in the first rotational direction, the curved surfaces each form a sine waveform (see FIGS. 8 and 9).

In the above configuration, the first cam portion 211A has a top point 211A1 (first top point) and a bottom point 211A2 (first bottom point). The second cam portion 211B has a top point 211B1 (first top point) and a bottom point 211B2 (first bottom point). The third cam portion 211C also has a top point 211C1 (first top point) and a bottom point 211C2 (first bottom point). As illustrated in FIG. 5A, the top points 211A1, 211B1, and 211C1 each are located at a position different from one another in the first rotational direction. Also, the top points 211A1, 211B1, and 211C1 are located the closest to the second cam gear 212 in the respective cam portions. That is, the top point 211A1 of all parts of the first cam portion 211A is located the closest to the second cam gear 212. The top point 221B1 of all parts of the second cam portion 211B is located the closest to the second cam gear 212. The top point 221C1 of all parts of the third cam portion 211C is located the closest to the second cam gear 212. The bottom points 211A2, 211B2, and 211C2 each are located at a position different from one another in the first rotational direction. The bottom points 211A2, 211B2, and 211C2 are located the farthest from the second cam gear 212 in the respective cam portions. That is, the bottom point 211A2 of all parts of the first cam portion 211A is located the farthest from the second cam gear 212. The bottom point 211B2 of all parts of the second cam portion 211B is located the farthest from the second cam gear 212. The bottom point 211C2 of all parts of the third cam portion 211C is located the farthest from the second cam gear 212. Furthermore, the top points 211A1, 211B1, and 211C1 are located such as to equally divide the first side surface 211S of the first cam gear 211 in the first rotational direction. The top points 211A1, 211B1, and 211C1 are displaced from one another for example by 120 degrees in rotational angle of the first rotational direction. Furthermore, the bottom points 211A2, 211B2, and 211C2 are located such as to equally divide the first side surface 211S of the first cam gear 211 in the first rotational direction. The bottom point 211A2, 211B2, and 211C2 are displaced from one another for example by 120 degrees in rotational angle of the first rotational direction. The bottom points 211A2, 211B2, and 211C2 are each located on the opposite side of a corresponding one of the top points of the respective cam portions in the first radial direction. That is, the top point 211A1 is located on the opposite side of the rotation center of the first cam gear 211 to the bottom point 211A2 and spaced from the bottom point 211A2 by 180 degrees in the first rotational direction. The top point 211B1 is located on the opposite side of the rotation center of the first cam gear 211 to the bottom point 211B2 and spaced from the bottom point 211B2 by 180 degrees in the first rotational direction. The top point 211C1 is located on the opposite side of the rotation center of the first cam gear 211 to the bottom point 211C2 and spaced from the bottom point 211C2 by 180 degrees in the first rotational direction. Note that although ridge lines extending in the radial direction of the respective cam gears are each drawn on a corresponding one of the cam portions in order to indicate the top points and the bottom points, the ridge lines are not visible actually.

The second cam gear 212 has second grooves 212P in addition to the fourth, fifth, and sixth cam portions 212A, 212B, and 212C. The fourth, fifth, and sixth cam portions 212A, 212B, and 212C and the second grooves 212P form the second side surface 212T.

The fourth cam portion 212A is disposed the most inward of the corresponding three cam portions of the second cam gear 212 in a radial direction of the second cam gear 212. The fourth cam portion 212A is a band-shaped protrusion protruding toward the first cam gear 211 such as to have a height varying in a rotational direction of the second cam gear 212 (second rotational direction). In other words, the fourth cam portion 212A has a specific width in the radial direction in rotation of the second cam gear 212 (second radial direction). The fourth cam portion 212A has a ring shape extending in the second rotational direction around the drum shaft 21G.

The fifth cam portion 212B is disposed in middle among the corresponding three cam portions. In other words, the fifth cam portion 212B is disposed outside the fourth cam portion 212A in the second radial direction in an adjacent manner. The fifth cam portion 212B is a band-shaped protrusion protruding toward the first cam gear 211 such as to have a height varying in the rotational direction of the second cam gear 212 (second rotational direction). In other words, the fifth cam portion 212B has a specific width in the radial direction in rotation of the second cam gear 212 (second radial direction). The fifth cam portion 212B has a ring shape extending in the second rotational direction around the drum shaft 21G.

The sixth cam portion 212C is disposed the most outward among the corresponding three cam portions in the radial direction of the second cam gear 212. In other words, the sixth cam portion 212C is disposed on an opposite side of the fifth cam portion 212B to the fourth cam portion 212A in the second radial direction such as to be adjacent to the fifth cam portion 212B. The sixth cam portion 212C is a band-shaped protrusion protruding toward the first cam gear 211 such as to have a height varying in the rotational direction of the second cam gear 212 (second rotational direction). In other words, the sixth cam portion 212C has a specific width in the radial direction in rotation of the second cam gear 212 (second radial direction). The sixth cam portion 212C has a ring shape extending in the second rotational direction around the drum shaft 21G.

The second grooves 212P each are a ring-shaped recess. One of the second grooves 212P is located between the fourth and fifth cam portions 212A and 212B in the second radial direction. The other second groove 212P is located between the fifth and sixth cam portions 212B and 212C in the second radial direction. The second grooves 212P each have a specific width in the second radial direction.

The fourth, fifth, and sixth cam portions 212A, 212B, and 212C in the present embodiment each have an upper surface (cam surface) that is continuously curved in the second rotational direction. When the curved surfaces are viewed in the second radial direction while being moved in the second rotational direction, the curved surfaces each form a sine waveform (see FIGS. 8 and 9).

In the above configuration, the fourth cam portion 212A has a top point 212A1 (second top point) and a bottom point 212A2 (second bottom point). The fifth cam portion 212B has a top point 212B1 (second top point) and a bottom point 212B2 (second bottom point). The sixth cam portion 212C also has a top point 212C1 (second top point) and a bottom point 212C2 (second bottom point). As illustrated in FIG. 5B, the top points 212A1, 212B1, and 212C1 each are located at a position different from one another in the second rotational direction. Also, the top points 212A1, 212B1, and 212C1 are located the closest to the first cam gear 211 in the respective cam portions. That is, the top point 212A1 of all part of the fourth cam portion 212A is located the closest to the first cam gear 211. The top point 212B1 of all parts of the fifth cam portion 212B is located the closest to the first cam gear 211. The top point 212C1 of all parts of the sixth cam portion 212C is located the closest to the first cam gear 211. The bottom points 212A2, 212B2, and 212C2 each are located at a position different from one another in the second rotational direction. The bottom points 212A2, 212B2, and 212C2 are located the farthest from the first cam gear 211 in the respective cam portions. That is, the bottom point 212A2 of all parts of the fourth cam portion 212A is located the farthest from the first cam gear 211. The bottom point 212B2 of all parts of the fifth cam portion 212B is located the farthest from the first cam gear 211. Furthermore, the bottom point 212C2 of all parts of the sixth cam portion 212C is located the farthest from the first cam gear 211. The top points 212A1, 212B1, and 212C1 are located such as to equally divide the second side surface 212T of the second cam gear 212 in the second rotational direction. The top points 212A1, 212B1, and 212C1 are displaced from one another for example by 120 degrees in rotational angle of the second rotational direction. The bottom points 212A2, 212B2, and 212C2 are located such as to equally divide the second side surface 212T of the second cam gear 212 in the second rotational direction. The bottom points 212A2, 212B2, and 212C2 are displaced from one another for example by 120 degrees in rotational angle of the second rotational direction. The bottom points 212A2, 212B2, and 212C2 are each located on the opposite side of a corresponding one of the top points of the respective cam portions in the second radial direction. That is, the top point 212A1 is located on the opposite side of the rotation center of the second cam gear 212 to the bottom point 212A2 and spaced from the bottom point 212A2 by 180 degrees in the second rotational direction. The top point 212B1 is located on the opposite side of the rotation center of the second cam gear 212 to the bottom point 212B2 and spaced from the bottom point 212B2 by 180 degrees in the second rotational direction. The top point 212C1 is located on the opposite side of the rotation center of the second cam gear 212 to the bottom point 212C2 and spaced from the bottom point 212C2 by 180 degrees in the second rotational direction.

Figure 6:
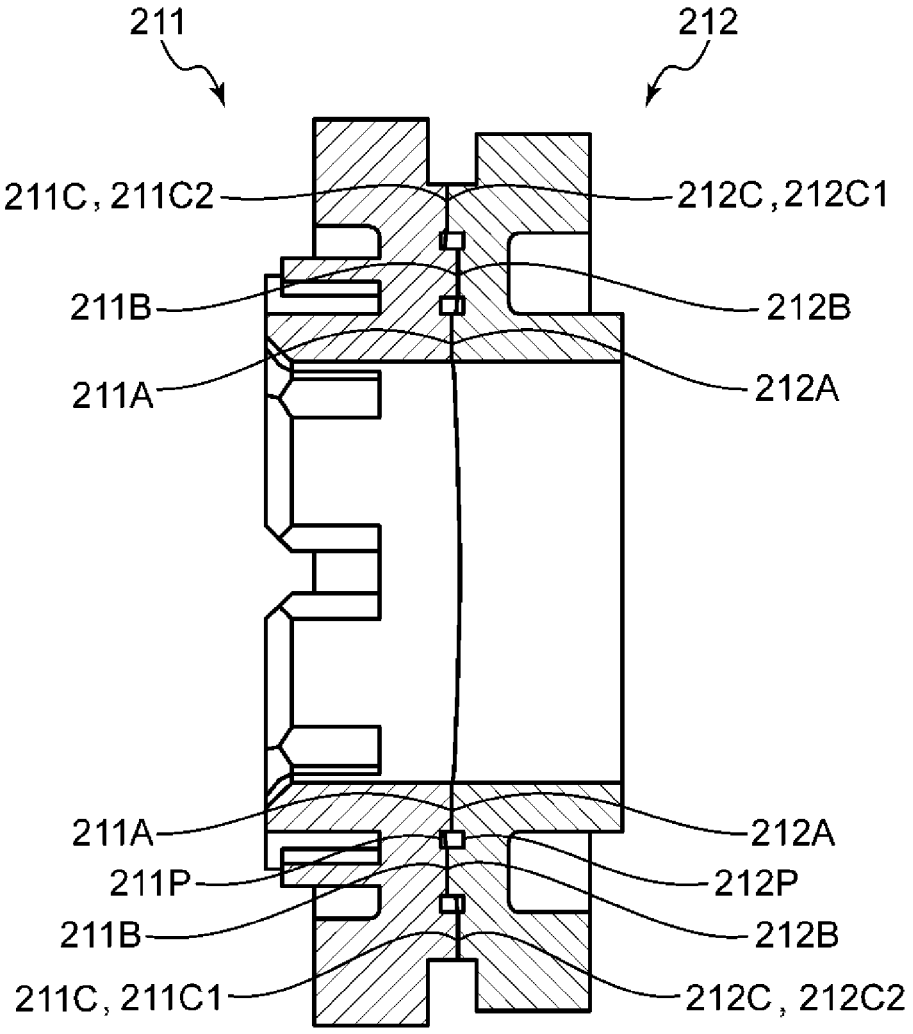
FIG. 6 is a cross-sectional view illustrating a state in which the first and second cam members are meshed together in an embodiment of the present disclosure.
Figure 7:
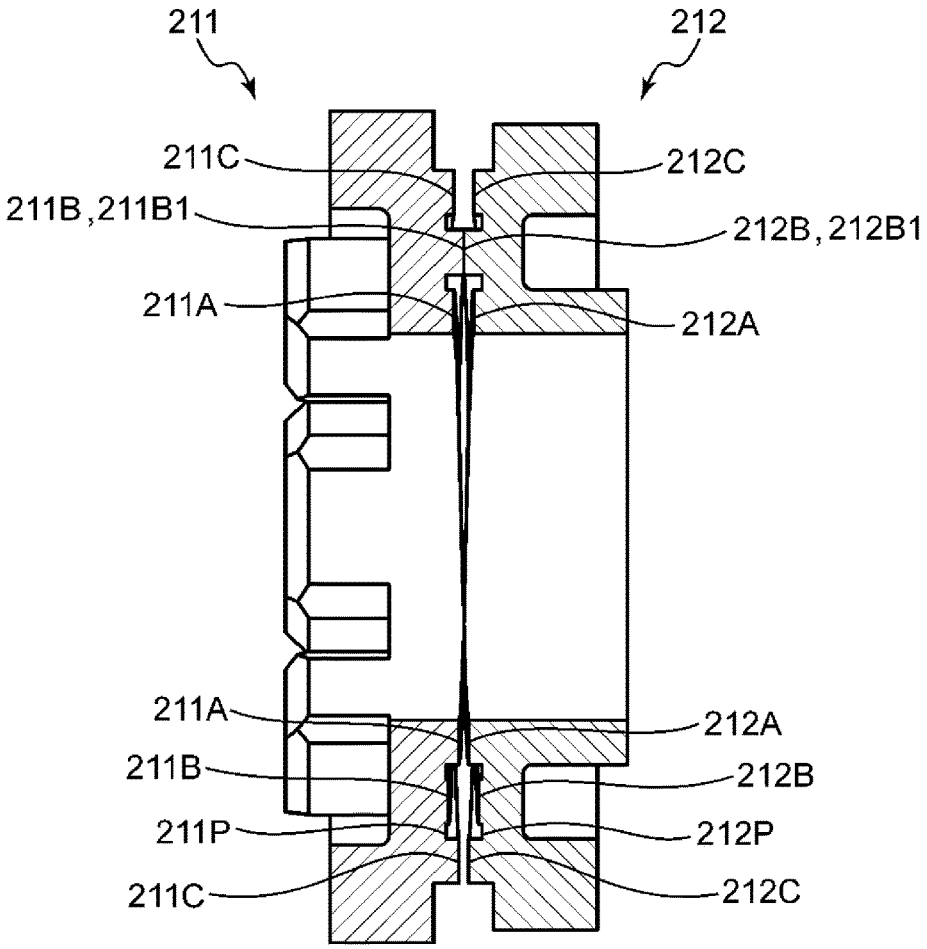
FIG. 7 is a cross-sectional view illustrating another state in which the first and second cam members are meshed together in an embodiment of the present disclosure.
Figure 8:
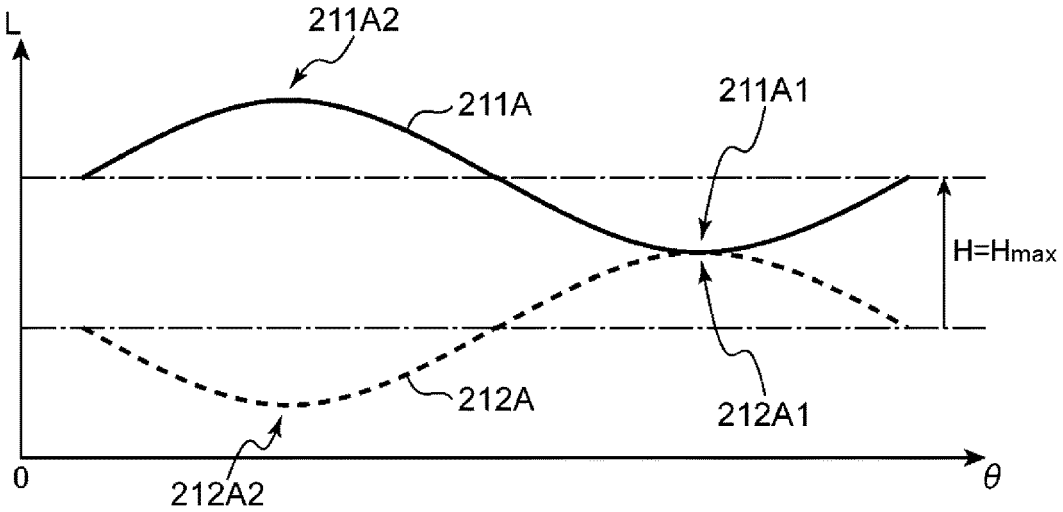
FIG. 8 is a schematic diagram illustrating mesh between the first and second cam members in an embodiment of the present disclosure.
Figure 9:
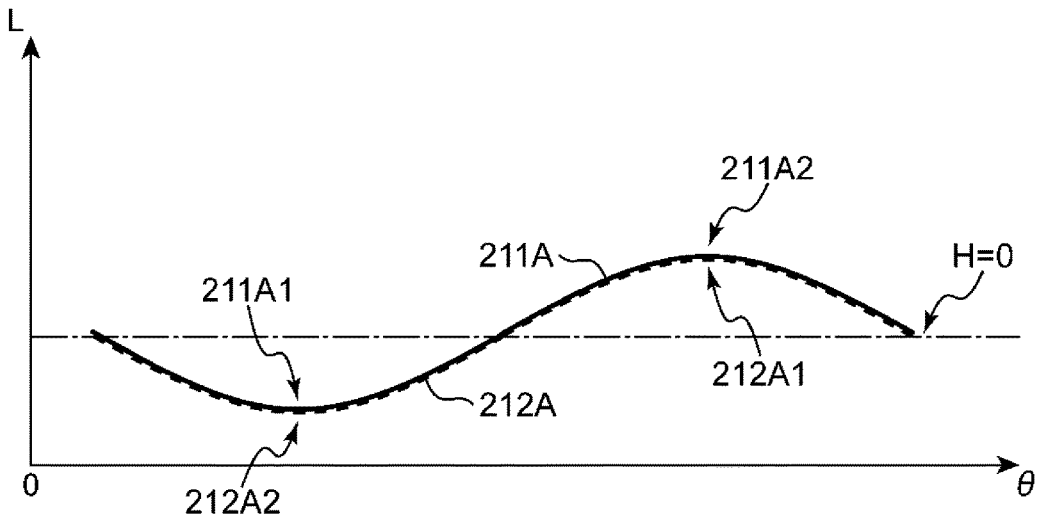
FIG. 9 is a schematic diagram illustrating another mesh between the first and second cam members in an embodiment of the present disclosure.

Description will be given next of reciprocation of the photosensitive drum 21 along with rotation of the first and second cam gears 211 and 212. FIGS. 6 and 7 are cross-sectional views each illustrating a state in which the first and second cam gears 211 and 212 according to the present embodiment are meshed together. FIGS. 6 and 7 each are a cross-sectional view of the first and second cam gears 211 and 212 when viewed in a direction intersected with the rotational directions of the first and second cam gears 211 and 212. That is, FIGS. 6 and 7 each are a cross-sectional view including respective axial lines of the first and second cam gears 211 and 212. FIGS. 8 and 9 each are a schematic diagram illustrating mesh between the respective cam surfaces of the first and second cam gears 211 and 212. In each of FIGS. 8 and 9, the horizontal axis represents rotational angles θ of the first and second cam gears 211 and 212 and the vertical axis represents coordinates L of the first and second cam gears 211 and 212 in the axial direction of the photosensitive drum 21.

As the first and second cam gears 211 and 212 rotate about the axis of the photosensitive drum 21, the top points 211A1, 211B1, and 211C1 of the first cam gear 211 come in contact with the top points 212A1, 212B1, and 212C1 of the second cam gear 212, respectively, in the present embodiment. As a result, the photosensitive drum 21 is positioned at a first position separate the most leftward from the second cam gear 212. Note that FIG. 7 illustrates a state in which the photosensitive drum 21 is positioned at the first position. When the photosensitive drum 21 is positioned at the first position, the top point 211B1 of the second cam portion 211B comes in contact with the top point 212B1 of the fifth cam portion 212B. FIG. 8 illustrates a state in which the top point 211A1 of the first cam gear 211 is in contact with the top point 212A1 of the second cam gear 212. When the top point 211A1 of the first cam gear 211 comes in contact with the top point 212A1 of the second cam gear 212, a distance H in the axial direction between the first and fourth cam portions 211A and 212A is Hmax, a maximum value. As such, when the three top points of the first cam gear 211 are in contact with the respective three top points of the second cam gear 212 in a state in which the photosensitive drum 21 is positioned at the first position, a positional relationship between the first and second cam gears 211 and 212 can be maintained stably and a fall of the first cam gear 211 relative to the axial direction of the photosensitive drum 21 can be prevented. Three-point contact is ensured during rotation of the first and second cam gears 211 and 212, and therefore, abrupt movement of the photosensitive drum 21 in the axial direction can be prevented. As a result, image displacement caused by abrupt movement of the photosensitive drum 21 can be prevented.

By contrast, when the first and second cam gears 211 and 212 are rotated from the state shown in FIGS. 7 and 8, a relative positional relationship therebetween changes by 180 degrees. That is, along with rotation of the first and second cam gears 211 and 212 about the axis of the photosensitive drum 21, the top points 211A1, 211B1, and 211C1 of the first cam gear 211 come in contact with (fit into) the bottom points 212A2, 212B2, and 212C2 of the second cam gear 212, respectively. As a result, the photosensitive drum 21 is positioned at a second position the closest to the second cam gear 212. Note that FIG. 6 illustrates a state in which the photosensitive drum 21 is positioned at the second position. When the photosensitive drum 21 is positioned at the second position, the bottom point 211C2 of the third cam portion 211C comes in contact with the top point 212C1 of the sixth cam portion 212C and the top point 211C1 of the third cam portion 211C comes in contact with the bottom point 212C2 of the sixth cam portion 212C. FIG. 9 illustrates a state in which the top point 211A1 of the first cam gear 211 is in contact with the bottom point 212A2 of the second cam gear 212 and the bottom point 211A2 of the first cam gear 211 is in contact with the top point 212A1 of the second cam gear 212. When the top point 211A1 of the first cam gear 211 comes in contact with the bottom point 212A2 of the second cam gear 212 and the bottom point 211A2 of the first cam gear 211 comes in contact with the top point 212A1 of the second cam gear 212, the distance H in the axial direction between the first and fourth cam portions 211A and 212A is zero, a minimum value.

When the above configuration of the drum unit 210 is adopted to each of the image forming units 2Y to 2Bk, displacement of respective color images can be prevented. As a result, color registration error of a full color image finally formed on a sheet can be prevented.

As described above, rotation of the first and second cam gears 211 and 212 moves the photosensitive drum 21 in the axial direction thereof in a reciprocal manner according to the present embodiment. In the above configuration, the contact point of the cleaning blade 271 in contact with the photosensitive drum 21 moves in the axial direction of the photosensitive drum 21. As a result, foreign matter and agglomerated developer caught between the cleaning blade 271 and the circumferential surface of the photosensitive drum 21 can be removed. A situation in which scratch formation or eccentric abrasion in the circumferential direction is caused on the circumferential surface of the photosensitive drum 21 can be prevented accordingly. The first and second cam gears 211 and 212 come in contact with each other at least three points in the rotational direction between the top points of the first cam gear 211 and the corresponding top or bottom points of the second cam gear 212 in reciprocation of the photosensitive drum 21. In the above configuration, the posture of the first and second cam gears 211 and 212 can be maintained stably when compared with a configuration in which the first and second cam gears are in one-point contact between a top point and a bottom point. Sliding pushing force in a tangent direction (see arrows DA in FIGS. 5A and 5B) is applied to the respective cam portions in contact between the first and second cam gears 211 and 212. In other words, the respective cam portions hardly receive sliding pushing force in the radial direction thereof. In the above configuration, the first and second cam gears 211 and 212 can be prevented from being displaced in the radial direction thereof. As a result, an abrupt fall of the cam portions and image displacement on the circumferential surface of the photosensitive drum 21 can be prevented.

The top points and the bottom points of the first and second cam gears 211 and 212 are located at respective positions that equally divide the corresponding cam gears in the present embodiment. In the above configuration, the posture of the first and second cam gears 211 and 212 can be maintained further stably in reciprocation of the photosensitive drum 21. The cam surfaces of the respective cam portions each are a curved surface continuous in the rotational direction. In the above configuration, the first and second cam gears 211 and 212 can smoothly come in contact with each other while rotating.

The first cam gear 211 has the first grooves 211P and the second cam gear 212 has the second grooves 212P in the present embodiment. In the above configuration, side parts of the cam portions of the respective cam members can be prevented from coming in contact with one another, resulting in that hindrance to rotation of the first and second cam gears 211 and 212 can be obviated.

The rotational drive force is transmitted from the first cam gear 211 to the second cam gear 212 via the first and second intermediate gears 211G and 212G in the present embodiment. In the above configuration, difference in the number of gear teeth between the first and second intermediate gears 211G and 212G causes the second cam gear 212 to rotate at a rotational speed different from that of the first cam gear 211. As a result, reciprocation of the photosensitive drum 21 can be achieved stably.

Referring to FIGS. 1 and 2A, the drum unit 210 is attachable to and detachable from the body housing 10 and detached from the body housing 10 by rightward sliding in the present embodiment. In so doing, the first and second cam gears 211 and 212 are positioned at a front end of the photosensitive drum 21 in a direction in which the drum unit 210 is detached (rear end thereof in a direction in which the drum unit 210 is attached). In the above configuration, a maintenance operator of the drum unit 210 can visually check the first and second cam gears 211 and 212 only by slightly drawing out the drum unit 210 from the body housing 10. As such, whether or not the first and second cam gears 211 and 212 are in a normal contact state can be easily checked. When stamps, cutaways, or marks are formed at positions (angle) corresponding to the respective top points or the respective bottom points in an outer surface of each of the first and second cam gears 211 and 212, rotation of the first and second cam gears 211 and 212 can be further easily checked by printing on several sheets.

As illustrated in FIGS. 5A and 5B, the first and second side surfaces 211S and 212T (flat portions), which are respectively located outside the third and sixth cam portions 211C and 212C located the most outward of the corresponding cam portions in the radial direction, are exposed by a specific width in the present embodiment. Foreign matter may enter into a cam portion or a cam portion may be broken when the drum unit 210 is removed from the body housing 10 as illustrated in FIG. 2A. However, such a situation can be prevented in the above configuration because the cam portions are located in an inward depth of the respective cam gears in the radial direction thereof. Furthermore, when a cam portion is broken or foreign mater enters into a cam portion, impact may occur in rotation of the photosensitive drum 21 to cause image displacement. However, the above configuration can prevent such a phenomenon.

An embodiment of the present disclosure has been described so far. However, the present disclosure is not limited to the above embodiment and the following alterations are possible.

(1) The first and second cam gears 211 and 212 each include three ring-shaped cam portions adjacent to one another in the radial direction in the above embodiment, which however should not be taken to limit the present disclosure. The cam gears may each include additional one or more concentric cam portions.

(2) Each of the cam portions of the first and second cam gears 211 and 212 has a single top point and a single bottom point in the above embodiment, which however should not be taken to limit the present disclosure. The cam portions each may have two or more top points and bottom points. The profile of the curved surface of each of the cam portions is not limited to the sine waveform and may have another waveform.

What is claimed is:

1. An image forming apparatus comprising:

a housing;

a photosensitive drum having a circumferential surface and supported to the housing in rotatable manner about an axis of the photosensitive drum, the circumferential surface of the photosensitive drum being a circumferential surface on which an electrostatic latent image is to be formed and a developer image is to be carried;

a cleaning member supported to the housing and configured to clean the circumferential surface of the photosensitive drum while in contact with the circumferential surface of the photosensitive drum; and a movement mechanism configured to reciprocate the photosensitive drum in an axial direction of the photosensitive drum, wherein the movement mechanism includes:

a first cam member fixed to the photosensitive drum and configured to rotate about the axis of the photosensitive drum together with the photosensitive drum in an integral manner; and a second cam member disposed opposite to the first cam member in the axial direction of the photosensitive drum and configured to rotate about the axis of the photosensitive drum at a rotational speed different from that of the first cam member, a position of the second cam member being restricted in the axial direction of the photosensitive drum, the first cam member includes:

a first cam portion having a ring shape extending around the axis of the photosensitive drum in a first rotational direction in which the first cam member rotates with a specific width in a first radial direction in rotation of the first cam member, the first cam portion protruding toward the second cam member such as to have a height varying in the first rotational direction;

a second cam portion having a ring shape extending around the axis of the photosensitive drum in the first rotational direction with a specific width in the first radial direction and disposed adjacent to the first cam portion, the second cam portion protruding toward the second cam member such as to have a height varying in the first rotational direction; and a third cam portion having a ring shape extending around the axis of the photosensitive drum in the first rotational direction with a specific width in the first radial direction and disposed adjacent to the second cam portion on an opposite side to the first cam portion in the first radial direction, the third cam portion protruding toward the second cam member such as to have a height varying in the first rotational direction, the second cam member includes:

a fourth cam portion having a ring shape extending around the axis of the photosensitive drum in a second rotational direction in which the second cam member rotates with a specific width in a second radial direction in rotation of the second cam member, the fourth cam portion protruding toward the first cam portion of the first cam member such as to have a height varying in the second rotational direction;

a fifth cam portion having a ring shape extending around the axis of the photosensitive drum in the second rotational direction with a specific width in the second radial direction and disposed adjacent to the fourth cam portion, the fifth cam portion protruding toward the second cam portion of the first cam member such as to have a height varying in the second rotational direction; and a sixth cam portion having a ring shape extending around the axis of the photosensitive drum in the second rotational direction with a specific width in the second radial direction and disposed adjacent to the fifth cam portion on an opposite side to the fourth cam portion in the second radial direction, the sixth cam portion protruding toward the third cam portion of the first cam member such as to have a height varying in the second rotational direction, the first, second, and third cam portions of the first cam member include:

respective first top points located closest to the second cam member at positions different from one another in the first rotational direction; and respective first bottom points located farthest from the second cam member at positions different from one another in the first rotational direction, the fourth, fifth, and sixth cam portions of the second cam member include:

respective second top points located closest to the first cam member at positions different from one another in the second rotational direction; and respective second bottom points located farthest from the first cam member at positions different from one another in the second rotational direction, when the first top points of the first, second, and third cam portions respectively come in contact with the second top points of the fourth, fifth, and sixth cam portions along with rotation of the first and second cam members about the axis of the photosensitive drum, the photosensitive drum is positioned at a first position farthest from the second cam member, and when the first top points of the first, second, and third cam portions respectively come in contact with the second bottom points of the fourth, fifth, and sixth cam portions along with rotation of the first and second cam members about the axis of the photosensitive drum, the photosensitive drum is positioned at a second position closest to the second cam member.

2. The image forming apparatus according to claim 1, wherein the respective first top points of the first, second, and third cam portions of the first cam member are located at positions that equally divide the first cam member in the first rotational direction, the respective first bottom points of the first, second, and third cam portions of the first cam member are located at positions that equally divide the first cam member in the first rotational direction and that each are opposite to a corresponding one of the first top points in the first radial direction, the respective second top points of the fourth, fifth, and sixth cam portions of the second cam member are located at positions that equally divide the second cam member in the second rotational direction, and the respective second bottom points of the fourth, fifth, and sixth cam portions of the second cam member are located at positions that equally divide the second cam member in the second rotational direction and that each are opposite to a corresponding one of the second top points in the second radial direction.

3. The image forming apparatus according to claim 1, wherein the first, second, and third cam portions of the first cam member each have a cam surface including a corresponding one of the first top points and a corresponding one of the first bottom points, the cam surface being continuous in the first rotational direction, and the fourth, fifth, and sixth cam portions of the second cam member each have a cam surface including a corresponding one of the second top points and a corresponding one of the second bottom points, the cam surface being continuous in the second rotational direction.

4. The image forming apparatus according to claim 1, wherein the first cam member has first grooves, one of the first grooves being located between the first and second cam portions in the first radial direction, the other of the first grooves being located between the second and third cam portions in the first radial direction.

5. The image forming apparatus according to claim 1, wherein the second cam member has second grooves, one of the second grooves being located between the fourth and fifth cam portions in the second radial direction, the other of the second grooves being located between the fifth and sixth cam portions in the second radial direction.

6. The image forming apparatus according to claim 1, wherein the first and second cam members each have an outer circumferential part on which gear teeth are disposed, the numbers of the gear teeth on the first and second cam members being different from each other, the image forming apparatus further comprises a pair of first and second intermediate rotary gears rotatable about an axis parallel to the axis of the photosensitive drum, the first intermediate rotary gear having teeth meshing with the gear teeth on the first cam member, the second intermediate rotary gear being disposed adjacent to the first intermediate rotary gear in an axial direction thereof and having teeth meshing with the gear teeth on the second cam member, the number of the teeth of the second intermediate rotary gear being different from that of the teeth of the first intermediate rotary gear, the second intermediate rotary gear rotating together with the first intermediate rotary gear, and when the photosensitive drum is rotated, rotation of the photosensitive drum is transmitted from the first cam member to the second cam member via the first and second intermediate rotary gears such that the second cam member rotates at a rotational speed different from that of the first cam member.

7. The image forming apparatus according to claim 1, wherein the respective cam surfaces of the first, second, and third cam portions of the first cam member each are continuously curved in the first rotational direction and form a sine waveform when viewed in the first radial direction while being moved in the first rotational direction.

8. The image forming apparatus according to claim 1, wherein the respective cam surfaces of the fourth, fifth, and sixth cam portions of the second cam member each are continuously curved in the second rotational direction and form a sine waveform when viewed in the second radial direction while being moved in the second rotational direction.

* * * * *